United States Patent [19]

Mardell

[11] 4,116,591

[45] Sep. 26, 1978

[54] FUEL INJECTION PUMPS

[75] Inventor: John Edward Mardell, Uxbridge, England

[73] Assignee: Lucas Industries Limited, Birmingham, England

[21] Appl. No.: 776,827

[22] Filed: Mar. 14, 1977

[30] Foreign Application Priority Data

Mar. 20, 1976 [GB] United Kingdom ..... 11319/76

[51] Int. Cl.[2] ..... F04B 17/04

[52] U.S. Cl. ..... 417/417; 123/32 AE; 310/80

[58] Field of Search ..... 417/410, 415–417, 417/356; 239/88; 123/139 E, 32 JV; 310/80

[56] References Cited

U.S. PATENT DOCUMENTS

| | | | |
|---|---|---|---|
| 2,829,631 | 4/1958 | Wilt | 417/417 |
| 3,171,585 | 3/1965 | Gauss | 417/417 |
| 3,353,040 | 11/1967 | Abbott | 310/27 |
| 3,464,627 | 9/1969 | Huber | 123/139 E |
| 3,842,809 | 10/1974 | King | 123/139 E |
| 3,913,537 | 10/1975 | Ziesche et al. | 123/139 E |
| 4,003,013 | 1/1977 | Seilly | 310/80 |
| 4,046,112 | 9/1977 | Deckard | 123/139 E |

*Primary Examiner*—C. J. Husar

[57] ABSTRACT

A fuel injection pump comprises a housing a pump assembly mounted within the housing and an annular armature slidable within a bore defined in the housing. The armature is connected to a moving part of the pump assembly and located in the annular space between the pump assembly and the armature is an annular field assembly including a member which is supported by an end closure for the housing. The field assembly carries a winding which when energized effects movement of the armature and movement of the moving part of the pump assembly thereby to displace fuel through an outlet.

10 Claims, 3 Drawing Figures

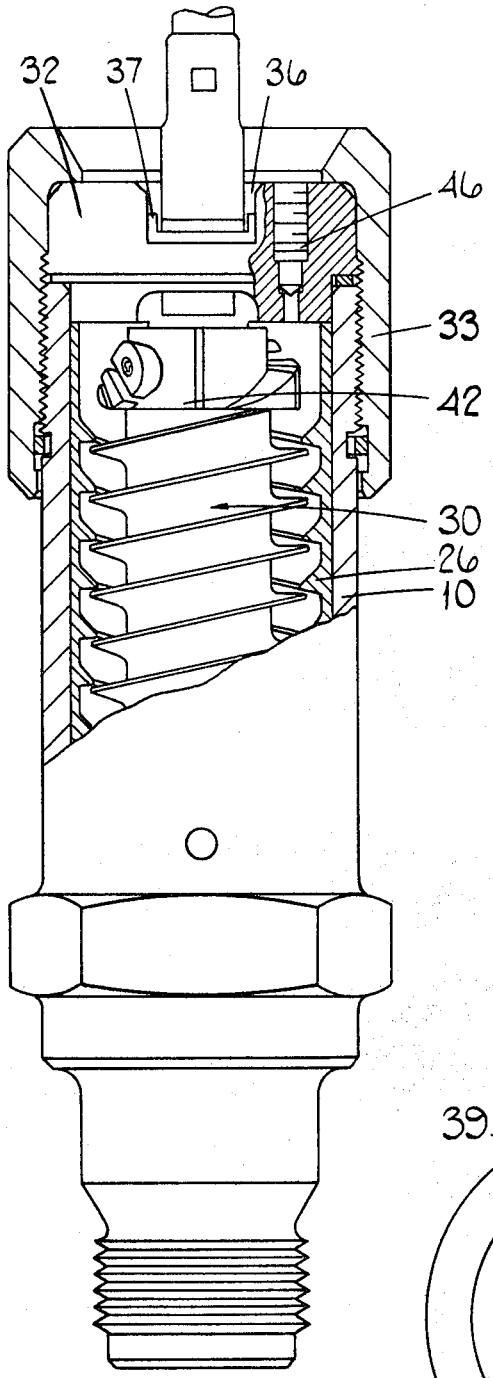
FIG. 2.
FIG. 3.
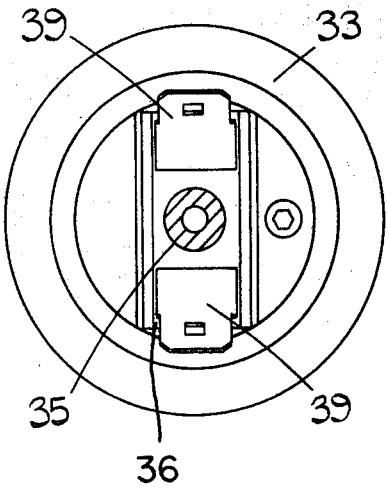

FUEL INJECTION PUMPS

This invention relates to fuel injection pumps for supplying fuel to internal combustion engines and has for its object to provide such a pump in a simple and convenient form.

According to the invention a fuel injection pump for the purpose specified comprises a housing defining a stepped cylindrical bore, a pump assembly secured within the narrower portion of the bore and extending into the wider portion thereof, an annular armature guided for movement by the wall of the wider portion of the bore, an annular field assembly disposed in a space defined between the armature and the pump assembly, said field assembly being supported by an end closure of the wider portion of the bore, means interconnecting the armature and a moving component of the pump assembly and a winding carried by the field assembly, the arrangement being such that when said winding is supplied with electric current, the armature is moved to effect movement of said component of the pump thereby to cause discharge of fuel through an outlet of the pump assembly.

One example of fuel injection pump in accordance with the invention will now be described with reference to the accompanying drawing in which;

FIG. 2 is a part sectional view taken at right angles to FIG. 1 and

FIG. 3 is a plan view of the pump.

Figure 1:
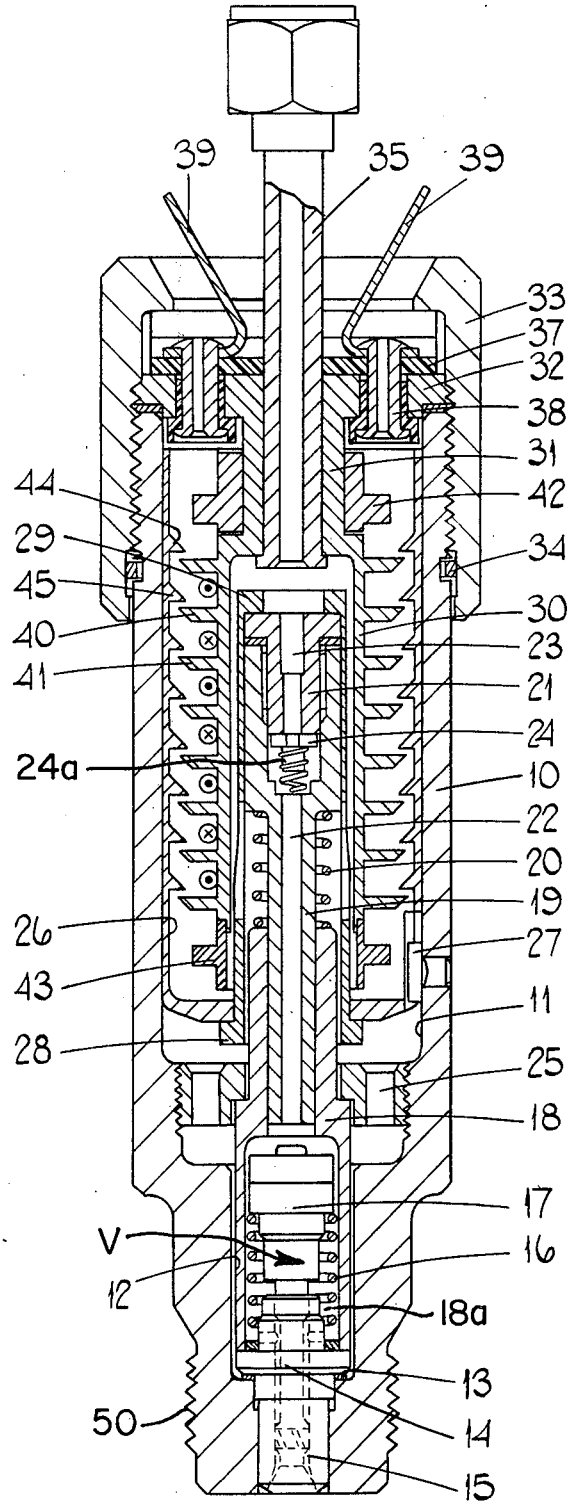
FIG. 1 is a sectional side elevation of the pump.

Referring to the drawings, the pump comprises a housing 10 in which is defined a stepped cylindrical bore having a wide portion 11 and an intermediate but narrower portion 12. At the end of the portion 12 of the bore remote from the wide portion of the bore there is defined a step 13 against which is located a flange 14 formed on a nozzle assembly 15. The nozzle assembly includes an outwardly movable valve element generally depicted by the letter V. The valve element is retained in biased position against its seating on the flange by means of a coiled compression spring 16 which is interposed between the flange 14 and a head 17 carried by the stem of the valve element.

The compression spring 16 and the aforesaid head 17 are located within a chamber **18*a* defined in a cylindrical part 18 forming part of a pump assembly. The remaining portions of the assembly include a pumping plunger 19 which is biased away from the aforesaid chamber 18*a* by means of a coiled compression spring 20. The pump assembly also includes a plug 21 which is screwed into an enlarged portion of a bore 22 extending within the plunger. The plug 21 is also provided with a bore 23 which constitutes an inlet for liquid fuel. Engageable with the inner end of the plug is a second valve element 24 which is biased into contact with the plug to close the bore 23 by means of a coiled compression spring 24*a*. The plunger 19 is slidable within a cylindrical bore defined in the part 18, the aforesaid chamber 18*a*** being an extension of the bore.

The part 18 is formed with a peripheral shoulder for engagement by an annular retaining member 25 which is screwed into a slightly narrower portion of the bore 11. When the retaining member 25 is tightened the annular lower end of the cylindrical part 18 is held in sealing engagement with the flange 14 and a washer is interposed between the flange 14 and the step 13. If the plunger is moved (depressed) against the action of the spring 20 then the volume of the bore 22 and the aforesaid chamber **18*a* is reduced and fuel thereby placed under pressure acts on the valve of the nozzle to lift the valve from its seating thereby to allow fuel to flow through an outlet of the nozzle. The periphery of the housing 10 is provided with a screw thread 50 whereby it can be secured within a complimentary bore in the cylinder head of an associted engine and thereby the fuel displaced by the plunger is directed into a combustion space of the engine. When the plunger is released the spring 20 urges the plunger away from the aforesaid chamber and a fresh quantity of fuel is drawn into the bore 22 past the valve element 24, the fuel flowing through the bore 23**.

For actuating the plunger there is provided an electromagnetic device which includes an annular armature 26 slidable in the portion 11 of the bore. The armature is retained against angular movement by means of a guide pad 27 which is located within a groove formed in the periphery of the armature. At its lower end the armature extends inwardly and engages a flange 28 formed on a coupling means which includes a cylindrical body surrounding the plunger and having at its end remote from the flange 28 an inwardly directed flange 29 which is in engagement with the aforesaid plug 21.

The armature is moved by a magnetic field created by a field assembly which includes an annular member 30 disposed in the annular space defined between the coupling member and the armature. The annular member 30 is integrally formed with a support portion 31 the latter extending from an end closure 32 which is stepped so that it can be engaged in the open end of the wide portion 11 of the bore. The end closure is retained in position by means of a cap 33 which is in screw thread engagement with the housing 10 and can if desired, and as shown, be retained against disengagement by means of a locking ring 34 which as the cap is engaged with the body springs outwardly from a peripheral groove in the body into a position to engage with a step defined on the internal periphery of the cap.

The end closure 32 and the support portion 31 are drilled and accommodate an inlet conduit 35 which in use is connected to an external source of fuel. Moreover, the cap 33 is provided with an aperture through which the inlet conduit extends.

Formed in the outer surface of the end closure 32 is a diametrically disposed slot 36 in the base of which is a channel shaped electrical insulator 37 acting in conjunction with insulating bushes, to mount electrically conducting sleeves 38 which extend through the end closure. At their outer ends, the sleeves mount terminals 39 respectively for connection to a source of electric supply, the terminals extending through the aperture in the end cap 33.

Formed on the outer periphery of the annular member 30 which forms the support of the field assembly, is a two-start helical thread. This is best seen in FIG. 2. The thread defines troughs and between adjacent troughs are ribs 40, 41. The ribs 40, 41 are of helical form and interposed in the helical troughs between the ribs is a continuous electrical winding. The winding starts from one of the sleeves 38 and passes along one of the troughs and then returns along the other trough for connection to the other sleeve 38. A single turn winding has been described but it will be appreciated that the winding may be provided with a plurality of turns. The end portions of the winding are located in an annular insulating member 42 which surrounds the support portion 31 and a similar insulating member 43 is provided at the opposite end of the field assembly. In use when electric current is passed through the winding the ribs 40, 41 will be polarised so that they are of opposite magnetic polarity. The armature on its internal peripheral surface, is provided with further ribs 44, 45, these ribs again being of helical form and extending partially into the troughs defined between the ribs 40, 41. As will be seen from the drawings the ribs 44, 45 and 40, 41 are shaped so that substantially parallel (when considered in section,) faces are provided in spaced relationship and when the winding is energised attraction between these faces moves the armature downwardly as seen in the drawings thereby to effect a pumping action as described.

The interior of the housing in use, is completely filled with fuel and a bleed vent 46 is provided in the end closure to enable air to be bled from the housing. The inlet 35 is connected to a source of fuel at low pressure, the pressure being insufficient to effect compression of the spring 20.

The pump when actuated delivers a predetermined volume of fuel and this volume of fuel can be adjusted by means of a suitably positioned stop which limits the movement of the armature or it can be arranged that abutment of the aforesaid ribs limits the movement of the armature. In this latter case angular adjustment of the field assembly within the housing will enable the amount of fuel supplied by the pump to be adjusted. Termination of the delivery of fuel can be obtained in three ways. Firstly the current can be allowed to continue to flow in the winding in which case normal pressure decay will terminate the delivery of fuel. Alternatively the winding may be de-energised when the maximum stroke has been obtained and in this case the plunger will return under the action of the spring thereby lowering the fuel pressure which is applied to the injection nozzle. Alternatively the winding may be de-energised before it reaches it limit position.

The construction of the field assembly and armature is described in U.S. Pat. No. 4,003,013.

I claim:

1. A fuel injection pump for supplying fuel to an internal combustion engine comprising a housing defining a stepped cylindrical bore, comprising a cylindrical member defining a pumping chamber and having a discharge outlet, said cylindrical member being secured within the narrower portion of said bore, a pumping plunger slidable into and out of said cylindrical member and extending into the wider portion of said bore, a fuel inlet to said chamber from the bore, and resilient means normally biasing the plunger outwardly of said cylindrical member to maintain said chamber at a maximum volume, an annular armature guided for movement by the wall of the wider portion of the bore, an annular field assembly disposed in a space defined between the armature and the plunger, said field assembly being supported by an end closure of the wider portion of the bore, means interconnecting the armature and the plunger and a winding carried by the field assembly, means for supplying said winding with electric current actuating the armature to effect movement of said plunger into said chamber reducing the volume thereof thereby to cause discharge of fuel under pressure through the outlet.

2. A pump as claimed in claim 1 including a fuel inlet in said end closure and terminals carried by said end closure, said terminals being connected to said winding.

3. A pump as claimed in claim 1 which flow of fuel through said outlet is controlled by a pressure responsive valve element.

4. A pump as claimed in claim 3 in which said valve element forms part of a nozzle assembly.

5. A pump according to claim 1 in which said fuel inlet comprises a passage extending axially within the plunger, and said passage accommodating a spring loaded valve operable to prevent escape of fuel from said chamber to the interior of the housing.

6. A pump according to claim 5 including a fuel inlet in said end closure, said fuel inlet communicating with the interior of the housing.

7. A pump according to claim 1 in which the means interconnecting the plunger and the armature comprising a tubular member disposed within an annular space defined between the plunger and said field assembly, said tubular member having an inwardly extending flange, at one end which engages with said plunger and a outwardly extending flange at the other end and which is engaged by said armature.

8. A pump according to claim 7 in which the cylindrical member of the pump assembly is retained within the narrower portion of the bore in the housing by a screw threaded retaining ring engaged with complementary screw threads formed on the wider portion of the bore adjacent the narrower portion of the bore.

9. A pump according to claim 1 in which said armature is provided with a pair of helical ribs on its internal peripheral surface, said annular field assembly comprising a tubular element having complementary ribs on its outer peripheral surface, the ribs on the element being of smaller axial width than the grooves defined between adjacent ribs on the armature, the ribs on the armature and element interengaging with each other so that limited axial movement can take place between the armature and element, said winding being located within the grooves defined between the ribs on the tubular element, the winding being arranged so that the direction of electric current flow in the portions of the winding in adjacent grooves is in the opposite direction.

10. A pump according to claim 9 including means for preventing rotation of said armature.

* * * * *